US006615413B1

(12) United States Patent
Grant et al.

(10) Patent No.: US 6,615,413 B1
(45) Date of Patent: Sep. 9, 2003

(54) TOILET MOUNTING ASSEMBLY

(76) Inventors: Rodney C. Grant, 1125 Mc Kittrick St. Unit 30, Wenatchee, WA (US) 98801; Robbie Grant, 2152 Turquoise Ridge #205, Las Vegas, NV (US) 89117

( * ) Notice: Subject to any disclaimer, the term of this patent is extended or adjusted under 35 U.S.C. 154(b) by 0 days.

(21) Appl. No.: 10/126,531

(22) Filed: Apr. 19, 2002

(51) Int. Cl.[7] ..... E03D 11/16

(52) U.S. Cl. ..... 4/252.1; 4/252.2; 4/252.3; 4/252.4; 4/252.6; 285/56; 285/57; 285/58; 411/84; 411/85; 411/104

(58) Field of Search ..... 4/252.1–252.6; 285/56, 57, 58; 411/84, 85, 104

(56) References Cited

U.S. PATENT DOCUMENTS 3,921,229 A * 11/1975 Yavitch ..... 4/252.5
4,502,166 A * 3/1985 Brown, Sr. ..... 4/252.5
4,907,301 A * 3/1990 Tucker ..... 4/252.5
5,018,224 A * 5/1991 Hodges ..... 4/252.6
5,185,890 A * 2/1993 Dismore et al. ..... 4/252.5
5,421,036 A * 6/1995 Stevens et al. ..... 4/252.1
5,937,450 A * 8/1999 Jones ..... 4/252.1
6,128,947 A * 10/2000 Anderson, Sr. ..... 73/46
6,302,628 B1 * 10/2001 Berecz et al. ..... 411/84

* cited by examiner

*Primary Examiner*—Gregory L. Huson
*Assistant Examiner*—Azy Kokabi

(57) ABSTRACT

A toilet mounting assembly for securely and easily mounting a toilet to a structure includes a sealing ring securable to a structure and having either integral threaded rods extending from a main body portion of the sealing ring or threaded rods easily and securely attached to the sealing ring using a tongue and groove. Alternately, the sealing ring may include threaded apertures for receiving specially structured bolts to secure the toilet to the sealing ring.

16 Claims, 5 Drawing Sheets

TOILET MOUNTING ASSEMBLY

BACKGROUND OF THE INVENTION

1. Field of the Invention

The present invention relates to toilet mounting hardware and more particularly pertains to a new toilet mounting assembly for securely and easily mounting a toilet to a structure.

2. Description of the Prior Art

The use of toilet mounting hardware is known in the prior art. U.S. Pat. No. 5,185,890 to Dismore et al. describes a toilet bowl seating assembly having common nuts and bolts for clamping together a closet flange, centering funnel, sealing ring, and toilet seat. Another type of toilet mounting hardware is U.S. Pat. No. 3,967,836 to Izzi, Sr. disclosing an offset flange for connecting a toilet bowl to and an unaligned drainpipe. U.S. Pat. No. 3,775,780 to McEwen discloses a connector flange having various slots and holes to permit use of-standard nuts and bolts to attach to a toilet. U.S. Pat. No. 3,319,268 to Blumenkranz teaches another connector for attachment to between a drainpipe and a toilet using standard nuts and bolts. U.S. Pat. No. 3,601,823 to Isaacs discloses a unitary plastic cap, nut and washer combination particularly for attachment to a standard bolt for securing a toilet. U.S. Pat. No. Des. 273,413 to McMurray shows an ornamental appearance for a moisture diverting drainpipe for a toilet pipe.

While these devices fulfill their respective, particular objectives and requirements, the need remains for an improved toilet mounting assembly for securely and easily mounting a toilet to a structure.

SUMMARY OF THE INVENTION

The present invention meets the needs presented above by providing a sealing ring securable to a structure and having either integral threaded rods extending from a main body portion of the sealing ring or threaded rods easily and securely attached to the sealing ring using a tongue and groove. Alternately, the sealing ring may include threaded apertures for receiving specially structured bolts to secure the toilet to the sealing ring.

Still yet another object of the present invention is to provide a new toilet mounting assembly that is rust resistant to facilitate later disengagement of the toilet.

Even still another object of the present invention is to provide a new toilet mounting assembly that promotes secure connection of the toilet while reducing the possibility of damaging the toilet due to over tightening of standard hardware nuts and bolts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
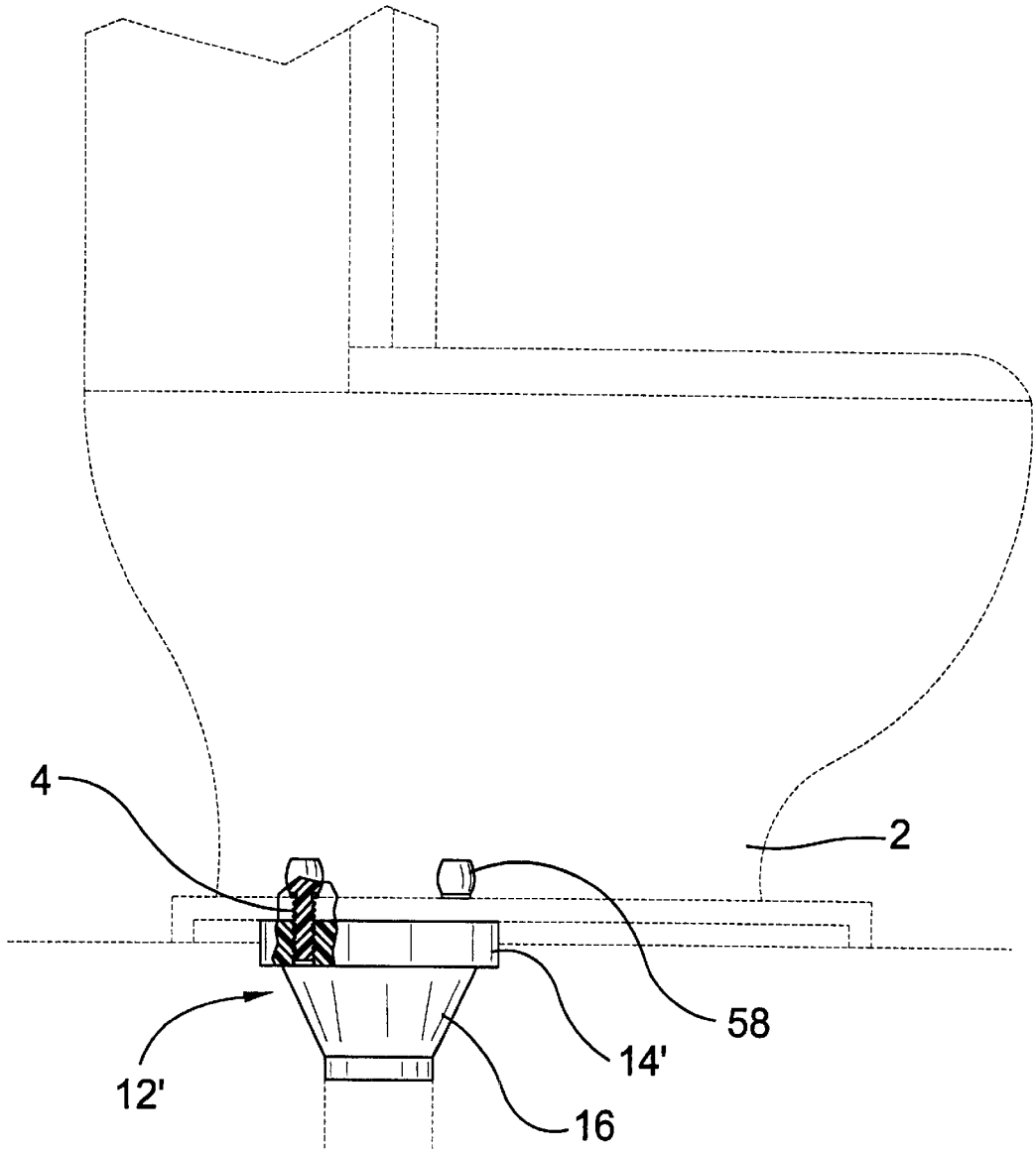
FIG. 1 is a partial cutaway side view of a new toilet mounting assembly according to the present invention.
Figure 2:
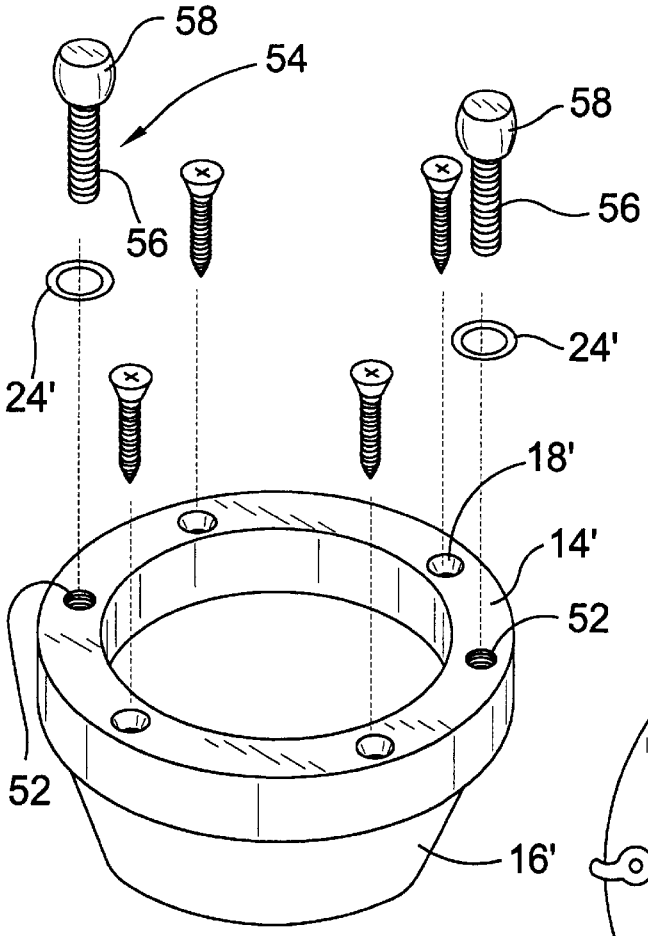
FIG. 2 is an exploded perspective view of the present invention.
Figure 3:
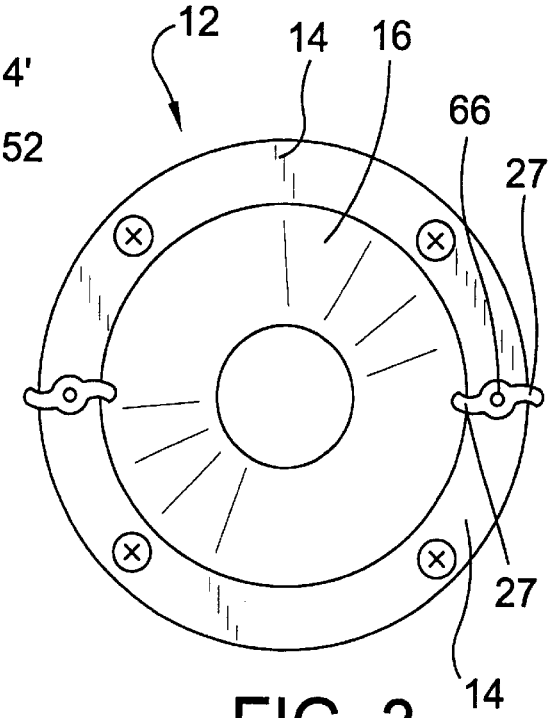
FIG. 3 is a top view of an embodiment of the present invention.
Figure 4:
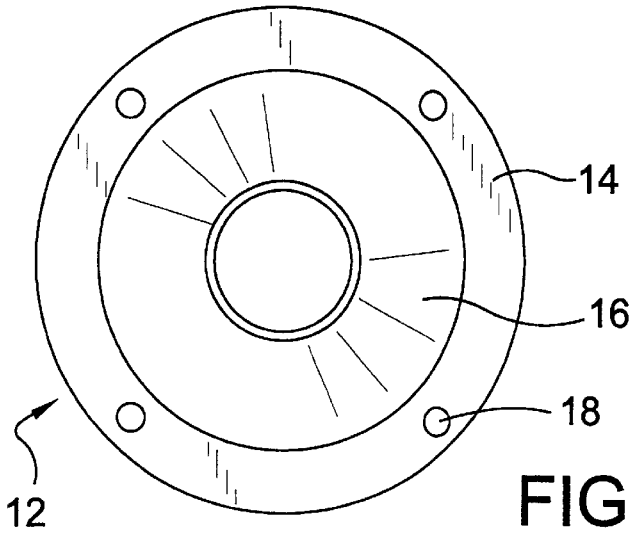
FIG. 4 is a top view of the sealing member of the present invention.
Figure 5:
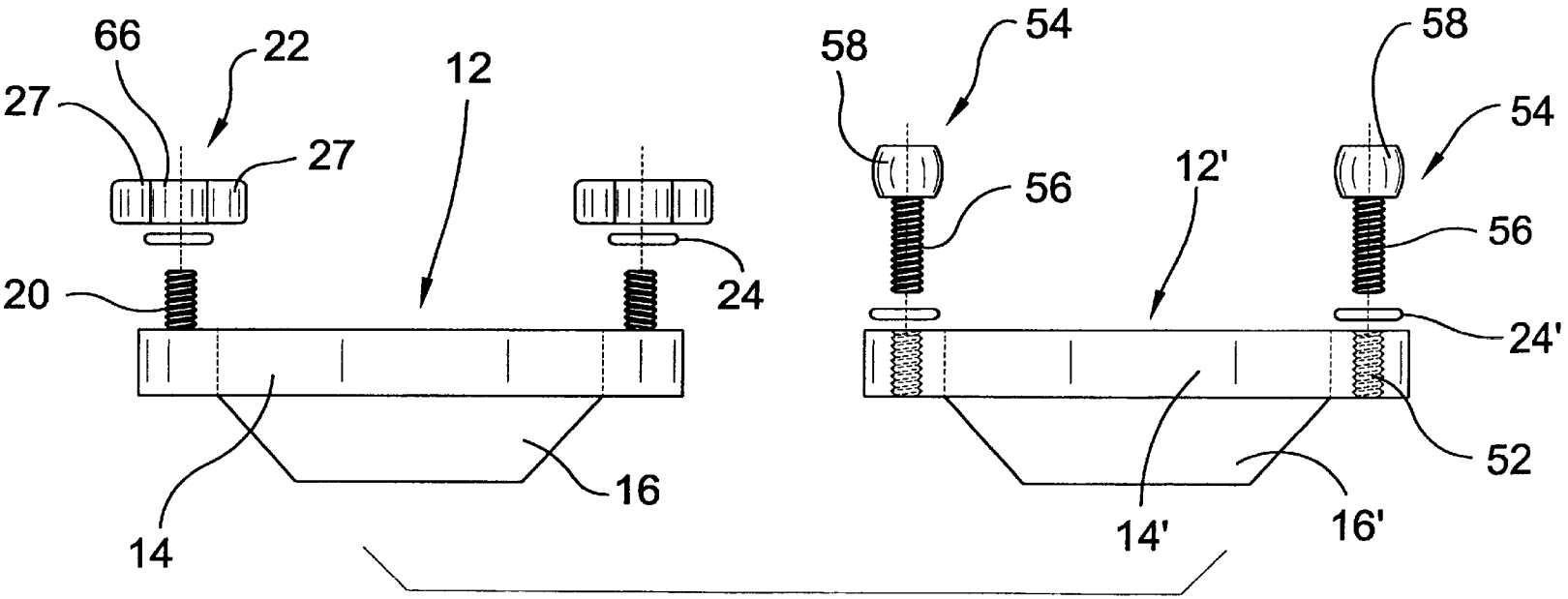
FIG. 5 is a side view of alternate embodiments of the present invention.
Figure 6:
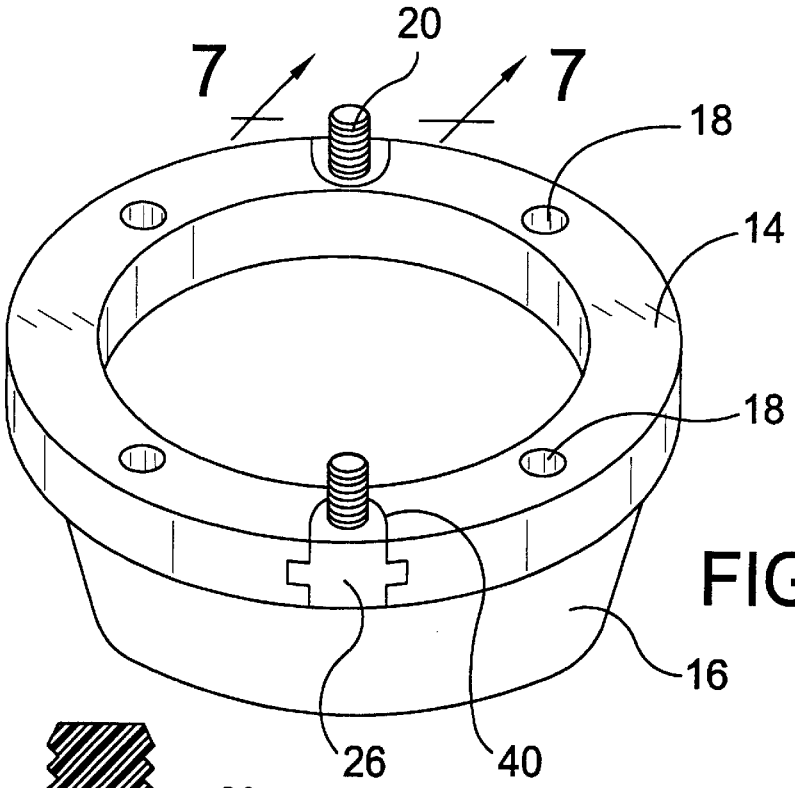
FIG. 6 is a perspective view of an embodiment of the present invention.
Figure 7:
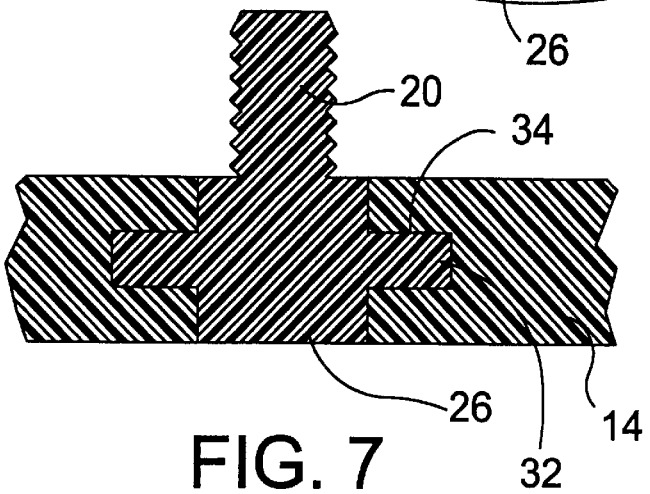
FIG. 7 is a cross-sectional view of the present invention taken along line 7—7 of FIG. 6.
Figure 8:
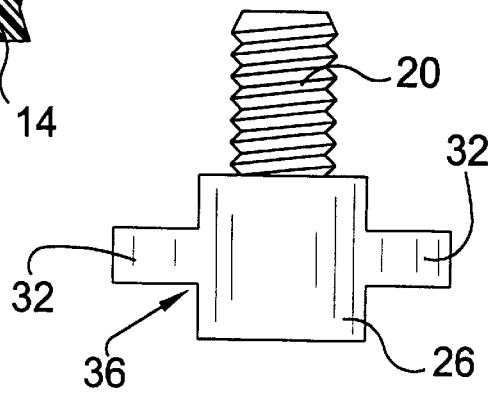
FIG. 8 is a side view of the connection member of the present invention.
Figure 9:
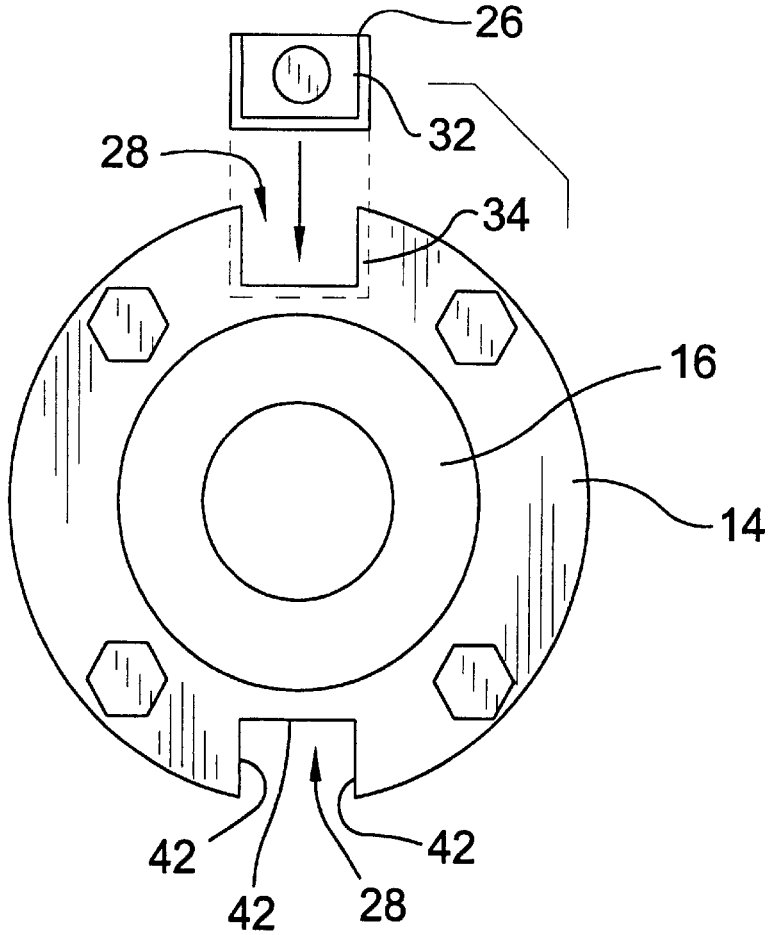
FIG. 9 is a top view of an embodiment of the present invention.
Figure 10:
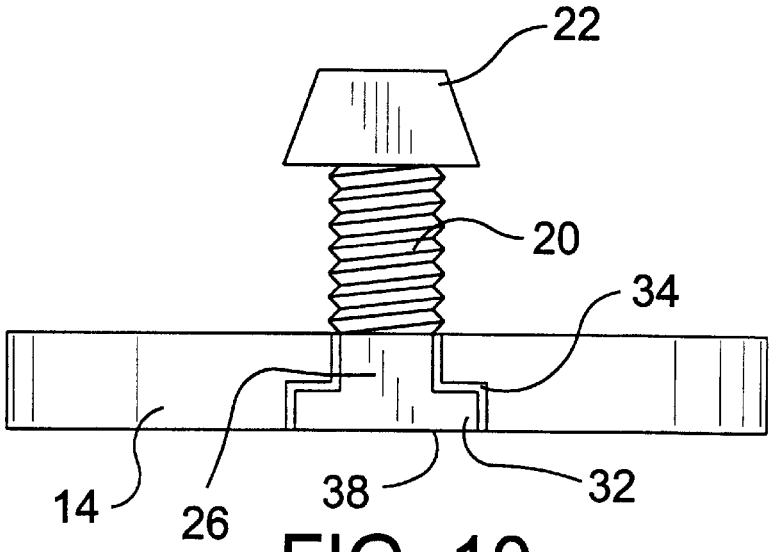
FIG. 10 is a side view of the embodiment of the present invention shown in FIG. 9.

With reference now to the drawings, and in particular to FIGS. 1 through 10 thereof, a new toilet mounting assembly embodying the principles and concepts of the present invention and generally designated by the reference numeral 10 will be described.

As best illustrated in FIGS. 1 through 10, the toilet mounting assembly 10 generally comprises a main member 12 that has a sealing portion 14 and a funnel portion 16 extending from the sealing portion 14. The sealing portion 14 includes a plurality of apertures 18. Thus, the sealing portion 14 is adapted for coupling to a structure, typically the floor of a bathroom. A plurality of threaded posts 20 extend upwardly from the sealing portion 14. The posts 20 are positioned for passing through connection apertures 4 of a toilet 2. A plurality of connection members 22 are engageable the posts 20 for securing the toilet 2 to the structure.

In an embodiment, each connection member 22 has a pair of diametrically opposed arcuate flanges 27 extending outwardly from a central portion 66 of the connection member 22 for facilitating hand tightening of the connection members 22.

A plurality of washers 24 are provided. Each washer 24 is secured between an associated one of the connection members 22 and the toilet 2.

In an embodiment, the sealing portion 14 includes a plurality of removable sections 26. Each of the threaded posts 20 extends from an associated one of the removable sections 26 to facilitate easy replacement of a broken or stripped post without having to completely dismantle or replace the toilet mounting. The sealing portion 14 has a plurality of cutouts 28 for receiving the removable sections 26. Each cutout 28 extends into the sealing portion from an outer wall 30 of the sealing portion 14.

Each removable section 26 includes a flange 32 extending outwardly from the removable section 26. Each cutout 28 includes a groove 34 complementarily positioned with respect to the flange 32 of the associated removable section 26 for receiving the flange 32. Thus, each removable section 26 is prevented from moving upwardly with respect to the sealing portion 14 when the flange 32 is positioned in the groove 34.

In an embodiment, each flange 32 extends from a medial portion 36 of the removable section 26. Alternately, each flange 32 extends from a bottom edge 38 of the removable section 26. Although it is typically desired to utilize consistent positioning of the flange for one sealing portion, it is contemplated that the positioning of the flange could be varied for one sealing portion. Various positioning of the flange is particularly if associating the positioning of the flange to a particular type of connection post and differing connection posts are desired for specific locations on the sealing portion.

In an embodiment, each cutout 28 is formed by an arcuate wall 40 extending into the sealing portion 14. Alternately, each cutout 28 is formed by three walls 42 extending into the sealing portion 14. The walls 42 may be positioned at right angles to each other or the outer walls may be flared outwardly.

In an alternate embodiment also permitting easy replacement of damaged posts, a main member 12' includes a sealing portion 14' and a funnel portion 16' extending from the sealing portion 14'. The sealing portion 14' includes a plurality of apertures 18'. Thus, the sealing portion 14' is designed for coupling to a structure.

The sealing portion 14' includes a plurality of threaded connection holes 52. Each of the holes 52 is positioned to align with connection holes 4 of the toilet 2. A plurality of connectors 54 are provided. Each connector 54 includes a threaded post portion 56 and a head portion 58. The threaded post portion 56 is engageable to a selectable one of the threaded connection holes 52. Thus, the head portion 58 secures the toilet 2 to the structure. Washers 24' are secured between the head portion 58 and the toilet 2. Each head portion 58 may integrally incorporate a decorative appearance such that no decorative cap is required to cover the connection as is commonly done to conceal the connection of a toilet to the floor.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet mounting assembly for mounting a toilet to a structure, the toilet mounting assembly comprising:

a main member having a sealing portion and a funnel portion extending from said sealing portion;

said sealing portion having a plurality of apertures whereby said sealing portion is adapted for coupling to the structure;

a plurality of threaded posts extending upwardly from said sealing portion, said posts being positioned such that said posts are adapted for passing through connection apertures of the toilet;

a plurality of connection members, each connection member being engageable to an associated one of said posts for securing the toilet to the structure;

said sealing portion including a plurality of removable sections; and each of said threaded posts extending from an associated one of said removable sections.

2. The toilet mounting assembly of claim 1, further comprising:

a plurality of washers, each said washer being secured between an associated one of said connection members and the toilet.

3. The toilet mounting assembly of claim 1 wherein said sealing portion has a plurality of cutouts for receiving said removable sections, each cutout extending into said sealing portion from an outer wall of said sealing portion.

4. The toilet mounting assembly of claim 3 wherein each said removable section includes a flange extending outwardly from said removable section;

each said cutout having a groove complementarily positioned with respect to said flange of said associated removable section for receiving said flange of said associated removable section whereby each said removable section is prevented from moving upwardly with respect to said sealing portion when said flange is positioned in said groove.

5. The toilet mounting assembly of claim 4 wherein each said flange extends from a medial portion of said removable section.

6. The toilet mounting assembly of claim 4 wherein each said flange extends from a bottom edge of said removable section.

7. The toilet mounting assembly of claim 3 wherein each said cutout is formed by an arcuate wall extending into said sealing portion.

8. The toilet mounting assembly of claim 3 wherein each said cutout is formed by three walls extending into said sealing portion.

9. The toilet mounting assembly of claim 8 wherein each of said three walls is positioned at a right angle to each adjacent one of said three walls.

10. A toilet mounting assembly for mounting a toilet to a structure, the toilet mounting assembly comprising:

a main member having a sealing portion and a funnel portion extending from said sealing portion;

said sealing portion having a plurality of apertures whereby said sealing portion is adapted for coupling to the structure;

a plurality of threaded posts extending upwardly from said sealing portion, said posts being positioned such that said posts are adapted for passing through connection apertures of the toilet;

a plurality of connection members, each connection member being engageable to an associated one of said posts for securing the toilet to the structure;

a plurality of washers, each said washer being secured between an associated one of said connection members and the toilet;

said sealing portion including a plurality of removable sections;

each of said threaded posts extending from an associated one of said removable sections;

wherein said sealing portion has a plurality of cutouts for receiving said removable sections, each cutout extending into said sealing portion from an outer wall of said sealing portion;

wherein each said removable section includes a flange extending outwardly from said removable section;

each said cutout having a groove complementarily positioned with respect to said flange of said associated removable section for receiving said flange of said associated removable section whereby each said removable section is prevented from moving upwardly with respect to said sealing portion when said flange is positioned in said groove.

11. The toilet mounting assembly of claim 10 wherein each said flange extends from a medial portion of said removable section.

12. The toilet mounting assembly of claim 10 wherein each said flange extends from a bottom edge of said removable section.

13. The toilet mounting assembly of claim 10 wherein each said cutout is formed by an arcuate wall extending into said sealing portion.

14. The toilet mounting assembly of claim 10 wherein each said cutout is formed by three walls extending into said sealing portion.

15. The toilet mounting assembly of claim 14 wherein each of said three walls is positioned at a right angle to each adjacent one of said three walls.

16. The toilet mounting assembly of claim 1 wherein each said connection member has a pair of diametrically opposed arcuate flanges extending outwardly from a central portion of said connection member for facilitating hand tightening of said connection members.

* * * * *